US006390696B1

(12) United States Patent
Concannon

(10) Patent No.: US 6,390,696 B1
(45) Date of Patent: May 21, 2002

(54) PRINTER EMPLOYING FUSER UNIT HAVING SELF-ADJUSTING TEMPERATURE

(75) Inventor: Tom Concannon, Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/896,414

(22) Filed: Jun. 28, 2001

(51) Int. Cl.[7] ..... B41J 2/315
(52) U.S. Cl. ..... 400/120.01; 400/118.2
(58) Field of Search ..... 400/120.01, 118.2

(56) References Cited

U.S. PATENT DOCUMENTS 4,672,177 A * 6/1987 Headrick ..... 219/216
4,920,250 A * 4/1990 Urban ..... 219/216
5,999,761 A * 12/1999 Binder et al. ..... 399/49

* cited by examiner

*Primary Examiner*—Andrew H. Hirshfeld
*Assistant Examiner*—Charles H. Nolan, Jr.

(57) ABSTRACT

A printer having a fuser controlled by sensing a temperature differences between at least two zones within the printer, detecting a prescribed temperature differential and then sending a signal to the fuser in order to change its operating temperature based upon the temperature difference sensed.

20 Claims, 3 Drawing Sheets

PRINTER EMPLOYING FUSER UNIT HAVING SELF-ADJUSTING TEMPERATURE

BACKGROUND OF THE INVENTION

1. Field of the Invention

The present invention generally relates to printers having fuser units that fuse toner, ink or other printing compositions to a sheet of print media such as a sheet of paper. More particularly, this invention relates to systems for improving the print quality of such printers by adjustment of the operating temperature of their fuser units.

2. Prior Art

It is well known that changes in the operating temperature of a printer's fuser unit can effect the quality of that printer's work product. For example, one print quality problem arises from the fact that printers in general, and their fuser units in particular, heat up during extended periods of use. These increasing temperatures can cause changes to those conditions under which a toner or ink best fuses to successive sheets of print media. Thus, increasing fuser temperatures can cause undesired changes in the overall quality of a printing task—and especially those printing tasks involving a large number of successively printed sheets.

Another print quality problem arises out of the fact that these fusing operations tend to shrink successive sheets of print media, to increasing degrees, as the fuser's operating temperature rises. In the case of paper print media, these fuser induced sheet size variations are related to the moisture content of successive sheets of paper undergoing printing. For example, it is well known that a sheet of standard 8½×11 inch bond paper can shrink as much as an eighth of an inch in either dimension as a result of going through a printer's fuser unit. A sheet of paper that has absorbed a great deal of the liquid component of an ink, or of a liquid toner, may shrink even more (e.g., up to a quarter of an inch). Those skilled in this art also will appreciate that paper shrinkage in the cross grain direction (normally the width of a sheet of paper) is usually greater than shrinkage in the grain direction (normally the length of a sheet of paper).

Such changes in paper size are generally regarded as being undesirable. They can be especially undesirable in duplex printing operations where a sheet of paper receives printed information within a bordered region on a first side and then undergoes a fusing operation in order to fuse that printed information to that first side. This fusing operation causes the paper to shrink. In a duplex printing operation, that shrunken sheet then undergoes printing on its second side. The information printed on the second side is sized (e.g., in a computer file) in the "expectation" that the print media upon which it is to be placed will be the same size (e.g., 8½×11 inches) as the sheet which received the first printing. This expectation may not be met. For example, an original 8½×11 inch sheet of paper may have shrunk as much as the previously noted quarter inch in each direction as a result of the fusing operation. In this circumstance, information printed on the second side of the sheet may appear to be larger because the sheet upon which it is printed is, in fact, smaller. Consequently, information appearing on the second side of some kinds of paper also will tend to "show through" the paper in the border regions of the printing on the first side of that sheet of paper. This condition can create visual effects in the border regions of the first side that vary from reader annoyance, to unprofessional appearance, to commercial unacceptability.

In order to accomplish the toner transfer part of such processes, a sheet of paper must pass between a transfer roller and a photoconductor drum. During the toner transfer, the transfer roller electromagnetically attracts toner particles away from the surface of the photoconductor drum and onto the surface of the sheet of paper. The electrical resistivity of the paper is one of the many factors involved in this toner transfer from the drum to the paper. This electrical resistivity is especially effected by the moisture content of the paper receiving the toner image. This moisture content is, in turn, effected by an electrophotographic printer's fuser temperature. Thus, in a duplex printing operation carried out by an electrophotographic printer, a fuser temperature change will cause a paper moisture change, which will cause a toner transfer change, which in turn will cause a print quality change.

Those skilled in this art also will appreciate that some printers have dealt with some fuser temperature related problems by allowing manual selection of a fuser temperature. Such selections are usually based upon the nature of the print media to be employed. For example, user selection of a heavy paper print media may call for the printer's use of a higher fuser temperature mode of operation. This higher temperature provides better print composition adhesion by producing the increased thermal mass transfer needed to sustain adequate fixing of a toner or ink to a heavier grade of paper. In making this selection, a human operator must first recognize that a heavy paper has been selected. That human must then push an appropriate button on the printer's control panel. If use of the heavier paper is not recognized, or its need for an increased fuser temperature not appreciated, or if the wrong control panel button is pushed, the quality of the printing may suffer.

Another example of a need for selection of a different fuser temperature operating mode might involve printing upon transparent print media since such media are usually best employed using relatively lower fuser temperatures. Such lower temperatures are needed in order to prevent melting or other deformation of the transparent print media itself. Here again, the user must realize that the transparent print media selected requires a lower fuser temperature, and then press the correct button on the printer's control panel to get that lower temperature.

Thus, under current practices, change of a printer's fuser temperature requires user recognition of a potential problem arising from the nature of the print media and a correct manual intervention via a front panel interface. Unfortunately, the need for even these relatively simple temperature changes are not intuitive in nature to most users. Moreover, user education is not always an effective way of dealing with this problem since many users do not read the printer's operating manual, or are otherwise unaware of the print quality problems that can be caused by selection of inappropriate fusing temperatures. Even fewer users are aware that a fuser's temperature may vary during extended printing operations and/or that these temperature variations can effect the quality of an overall printing task. Thus, many users often interpret poor fusing as a product quality issue. This can result in unneeded service calls—or unjustified user dissatisfaction.

SUMMARY OF THE INVENTION

Applicant addresses the previously noted fuser temperature change problems and/or mistaken manual selections at a printer's control panel by providing those printers that employ fuser units (e.g., electrophotographic printers, inkjet printers and so on) with a fuser temperature control system that automatically changes a fuser's operating temperature when such a change is needed. Hence, use of printers provided with the hereindescribed self-adjusting fuser temperatures minimize, or entirely eliminate, the need for user knowledge and/or user interaction with a printer's control panel.

In its broadest sense, the automatic fuser temperature changing printers of this patent disclosure are comprised of (1) a printer, (2) at least two temperature sensors and (3) a printer microprocessor component or separate computer that compares two sensed temperatures and sends signals to a fuser having two or more temperature modes. Applicant's automatic fuser temperature selection is preferably carried out by (1) a first temperature sensor in a first zone of the printer, (2) a second sensor in a second zone of the printer and (3) a microprocessor or computer for comparing temperatures sensed by the first and second temperature sensors and then making changes in the fuser's operating temperature based upon a prescribed (e.g., programmed) difference between the two temperatures. Thus, based upon a predetermined (and programmed) temperature difference (or "delta") existing between the two zones, the microprocessor or computer will send a signal to a fuser temperature control device that will change the fuser to a mode of operation employing a different temperature. If the temperature difference is "not large enough", the microprocessor or computer will not send a temperature change signal to the fuser's temperature control device.

Preferably, the fuser units used in applicant's printers will have several operating temperature modes (e.g., from two to about ten such modes are preferred; three modes "Low", "Medium" and "High" are even more preferred). Changes between these fuser temperature operating modes can be made based upon attainment of certain prescribed temperature differentials between the first zone and the second zone. Thus, such a microprocessor will first detect a temperature differential between a first sensor in a first zone of the printer and a second sensor in a second zone of that printer. The printer's microprocessor or computer would then (in conjunction with a predetermined computer program) determine whether or not that temperature differential is great enough to warrant changing the fuser to a different operating temperature mode.

In some of the more preferred embodiments of this invention, the fuser temperature selections are made based upon sensing a temperature differences between two zones that are located entirely within the housing of the printer. In some of the most preferred embodiments of this invention, the first such zone will lie between a sheet input side of the printer and its print mechanism (e.g., an electrophotographic printer's toner transfer mechanism, an inkjet printer's inkjet nozzles, etc.). Such a first zone also may be referred to as a "media input zone" in this patent disclosure. The second zone will lie between the fuser unit and a sheet exit side of the printer. This second zone may be hereinafter referred to as a "media output zone". Thus, if the temperature difference between the media input zone and the media output zone is not large enough, the microprocessor would assume that the fuser's temperature is not appropriate and it would select a new fuser temperature based upon the dictates of a computer program.

The underlying apparatus and principles of the present patent disclosure can be applied to any printer that employs a fuser unit (e.g., electrophotographic printers, inkjet printers, etc.). Consequently, those skilled in this art will appreciate that, for purposes of this patent disclosure, a "first" or a "media input zone" that includes a toner transfer unit is analogous to a "first" or "media input zone" that includes an inkjet print head. They are analogous because applicant's invention is primarily concerned with detecting a temperature in these zones rather than being concerned with the nature of the printing operations carried out in them. Similarly, applicant's invention is primarily concerned with detecting a temperature in a "second" or "media output zone" rather than with the mechanical operations carried in that second zone. Hence, the hereindescribed fuser temperature control systems can be used in inkjet printers, electrophotographic printers or any other printer that employs a fuser unit. Electrophotographic printers are, however, particularly well suited to the use of the hereindisclosed fuser temperature adjustment devices. Hence, application of the present invention to an electrophotographic printer will be emphasized to illustrate this invention.

Applicant's fuser units are preferably comprised of two opposing rollers that roll over each other in heated, pressured, rolling contact. In some of the more preferred embodiments of this invention, at least one of the two opposing rollers will contain a heating device that is heated by electrical power delivered to an inductive heater element or to a halogen tube. Other fusers may be in the form of a heated plate over which, or under which, a printed sheet passes. In either case, an appropriate signal from a printer's microprocessor to its fuser controller unit will cause that fuser controller unit to provide more (or less) power to such an inductive heater element or halogen tube and thereby change the fuser's operating temperature. Use of two opposing rollers wherein each of the two opposing rollers contains a heating device is also contemplated in the practice of this invention. Use of a powered heater roller also is contemplated. Use of two separately powered rollers also is possible, but not preferred. Moreover, one or both of the rollers may have a mechanism for adjusting the position of the rollers' axle—and hence adjusting the operating pressure of that roller with respect to the opposing roller, and hence with respect to a sheet of print media passing between the two rollers. Similarly, the rotational speed of a drive roller's axle may be increased or decreased to provide shorter or longer sheet residence times in the fuser unit.

The temperature and pressure conditions existing in the roller type fuser units of this patent disclosure (e.g., the fuser unit 46/48 shown in FIG. 2) can vary considerably. They can vary with respect to each other and they can vary with respect to the residence time of a sheet of print media (e.g., paper) passing through such a fuser unit. Generally speaking, these temperatures will vary between about 85° C. and about 96° C. Temperatures between about 87 and 91° C. are however somewhat preferred in those cases where polymer based toner particles are applied to a paper feedstock by an electrophotographic printer. The pressure conditions experienced by a sheet of media in applicant's fuser units will generally range between about 5 and about 8 psi. Pressures ranging between about 6 and about 7 psi are preferred, especially when the fuser unit's operating temperature is between about 87° C. and about 91° C. and the print media is paper.

The residence time of a sheet of print media in a such fuser unit will usually be determined by the angular velocity of a powered drive roller component of such a fuser (e.g., pressure roller 46 of FIG. 2). Typical residence times for 8½×11 inch sheets of paper generally will be from about 2 to about 8 seconds per sheet. Residence times of about 3 to about 6 seconds are somewhat more preferred. Thus, these preferred residence times generally correspond to 8½×11 inch paper processing rates of about 16 to about 32 sheets per minute. Generally speaking, shorter residence times will be used as the operating temperature is raised. For example, the lower end of the residence time range (e.g., 2–3 seconds) will generally be preferred as the temperature is raised toward the upper regions of its operating temperature range (e.g., between about 91° C. and about 93° C.).

Some of the more preferred embodiments of this invention will involve printers (electrophotographic printers, inkjet printers or other fuser-containing printers) wherein: (1) a first temperature sensor senses an ambient temperature in a first zone, (2) a first temperature sensor senses the temperature of a sheet of print media in a first zone, (3) a second temperature sensor senses an ambient temperature in a second zone, (4) a second temperature sensor senses the temperature of a sheet of print media in a second zone, (5) a first zone is located between the sheet input side of the printer and a point on a media path through the printer that is prior to the fuser unit, (6) a first zone is located between the sheet input side of an electrophotographic printer and a point on a media path through that printer that is prior to its toner transfer mechanism, (7) a first zone is located between a sheet input side of an inkjet printer and a point on the media path that is prior to its inkjet printer head, (8) a second zone is located between the sheet output side of a printer and a point on the media path through the printer that is just after the toner fuser unit, (9) a microprocessor unit of the printer or a separate and distinct computer unit send electrical signals to a fuser control unit in order to change the fuser unit's operating temperature and its operating pressure, (10) a microprocessor unit of the printer or a separate and distinct computer unit sends electrical signals to a fuser control unit in order to change the fuser unit's operating temperature and its operating speed, (11) a microprocessor unit of the printer or a separate and distinct computer unit sends electrical signals to a fuser control unit in order to change the fuser unit's operating temperature, pressure and speed, (12) a fuser unit has two opposing rollers and wherein at least one of the two opposing rollers contains a heating device employing an inductive heater element, (13) a fuser unit has two opposing rollers and wherein at least one of the two opposing rollers contains a heating device employing a halogen tube, (14) a fuser unit has two opposing rollers and wherein each of the two opposing rollers contains a heating device, (15) a fuser unit has an operating speed such that a sheet of 8½×11 inch paper passing through said fuser unit has a residence time therein of from about 2 to about 8 seconds, (16) a fuser unit has an operating speed such that a sheet of 8½×11 inch paper passing through said fuser unit has a residence time therein of from about 2 to about 3 seconds and (17) a fuser unit is a heated plate that does not contact a printed sheet as said sheet passes over or under said heated plate.

DETAILED DESCRIPTION OF INVENTION

Figure 1:
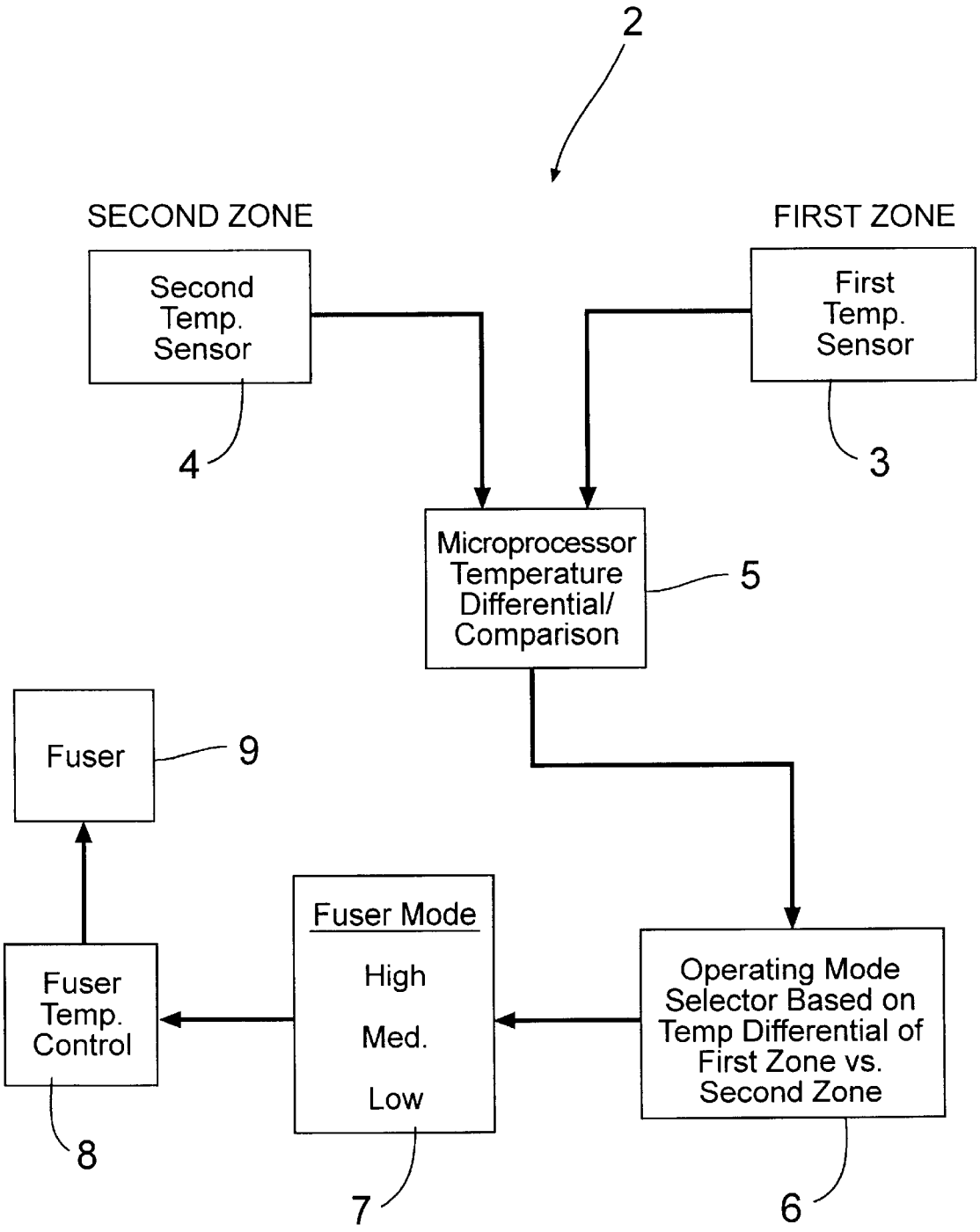
FIG. 1 is a block diagram of certain components of a control system for the printers of this patent disclosure.

FIG. 1 is a block diagram of certain components of a control system 2 of the present patent disclosure wherein a printer (such as the electrophotographic printer depicted in FIG. 2 or the inkjet printer depicted in FIG. 3) is further provided with said control system 2 in order to carry out certain sensing, comparing, signaling and operating functions. This control system 2 has a first temperature sensor 3. This first temperature sensor can operate in any one of several different zones within a printer that can be called a "first zone" according to the teachings of this invention (see first zone(s) $I_a$, $I_b$ and/or $I_c$ of the electrophotographic printer 10(E) of FIG. 2 and first zone(s) $I_{a(1)}$, $I_{b(1)}$ and/or $I_{c(1)}$ of the inkjet printer 10(I) of FIG. 3). Hence, applicant's general use of the terms "first zone" or "zone I" can be taken to mean any zone in a printer, but especially any of the first zones (e.g., Zone $I_a$, Zone $I_b$, Zone $I_c$ depicted in FIG. 2 or the first zones depicted in the inkjet printer of FIG. 3). In such a first zone, the first sensor 3 can detect an ambient temperature in said first zone or the temperature of the print media itself in that first zone. For the purposes of this patent disclosure, the term "ambient" temperature can be taken to mean the temperature of the atmosphere in the first zone. This term also can be taken to mean the temperature of some particular mechanical component of the printer that is located in the first zone. Hence, applicant's use of expressions such as "first zone temperature sensor" can be taken to mean a sensor that senses the temperature of the atmosphere and/or the temperature of a specific mechanical component in that first zone.

It also should be specifically noted that in one particularly preferred embodiment of this invention, the temperature sensor 3 will detect the temperature of a sheet of print media itself (e.g., a sheet of paper) while it is in the first zone. This print media temperature sensing can be in place of (or in addition to) an ambient temperature sensing in the first zone. Hence, there can be two or more temperature sensors in the first zone. For example, two temperature sensors $\mathbf{3}_a$ and $\mathbf{3}_b$ are shown in the first zones $I_a$ and $I_b$ depicted in FIG. 2. By way of contrast, the first zone $I_c$ is shown provided with only one first sensor, i.e., first temperature sensor $\mathbf{3}_b$.

Figure 2:
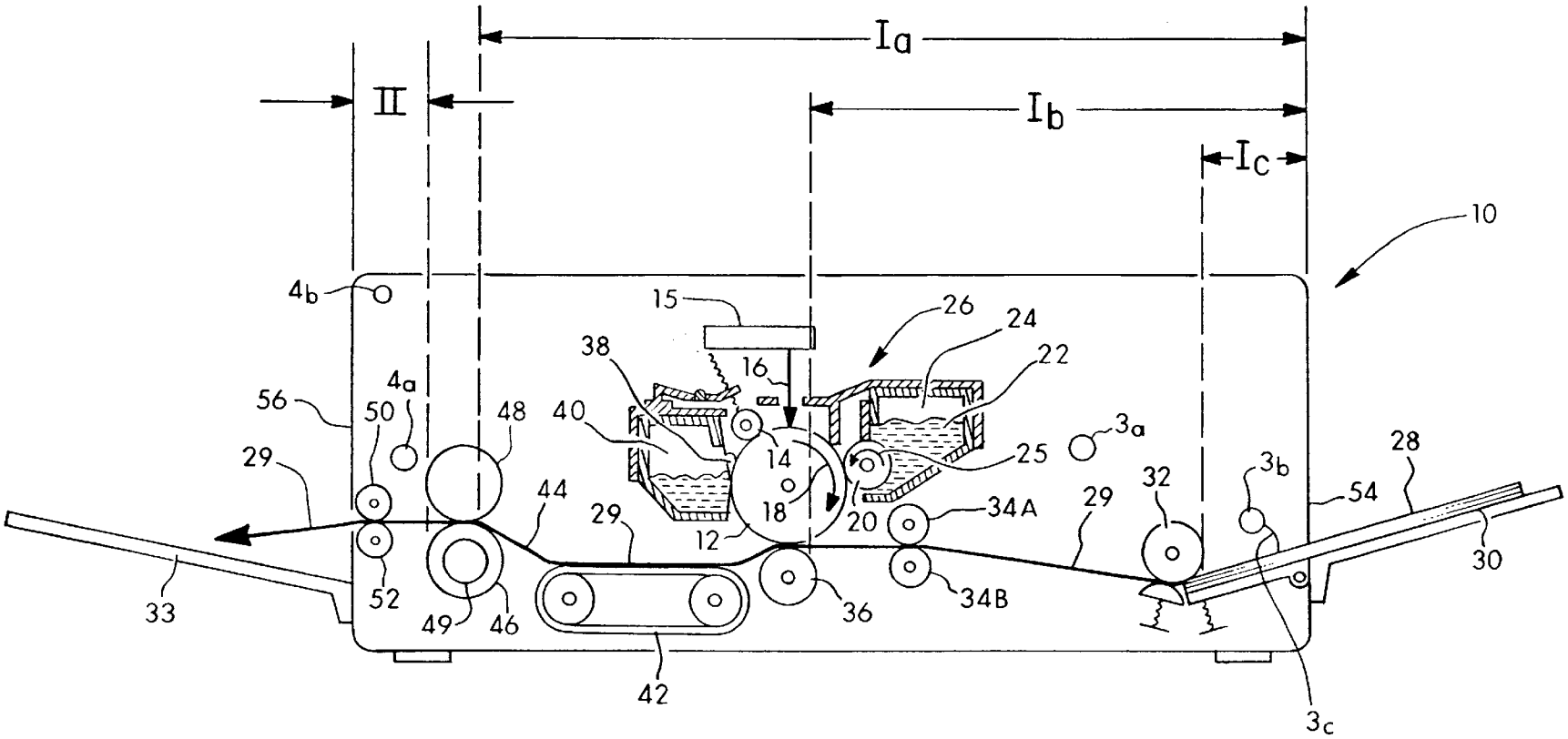
FIG. 2 is a cross sectional view of an electrophotographic printer provided with a temperature sensing system constructed according to the present invention.
Figure 3:
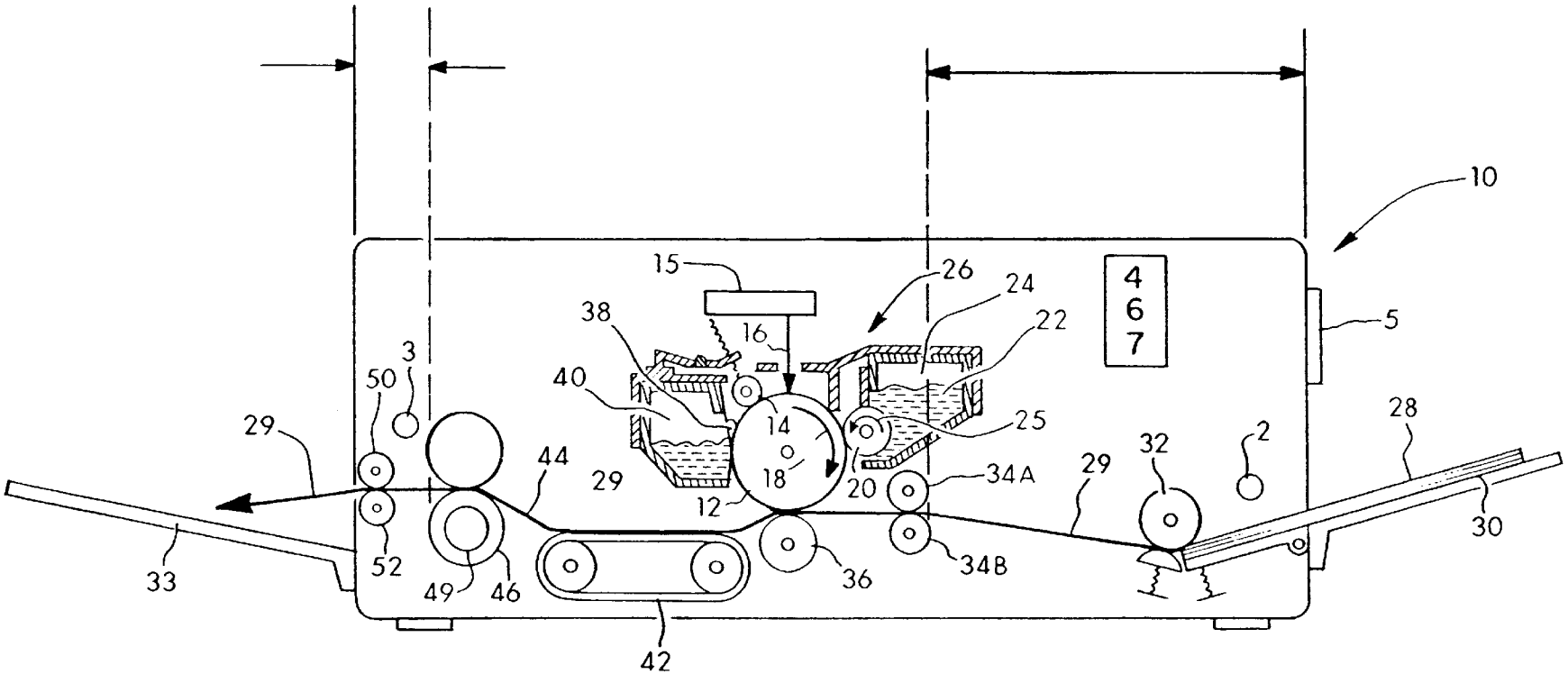
FIG. 3 is a cross sectional view of an inkjet printer provided with a temperature sensing system constructed according to the present invention.
Figure 3:
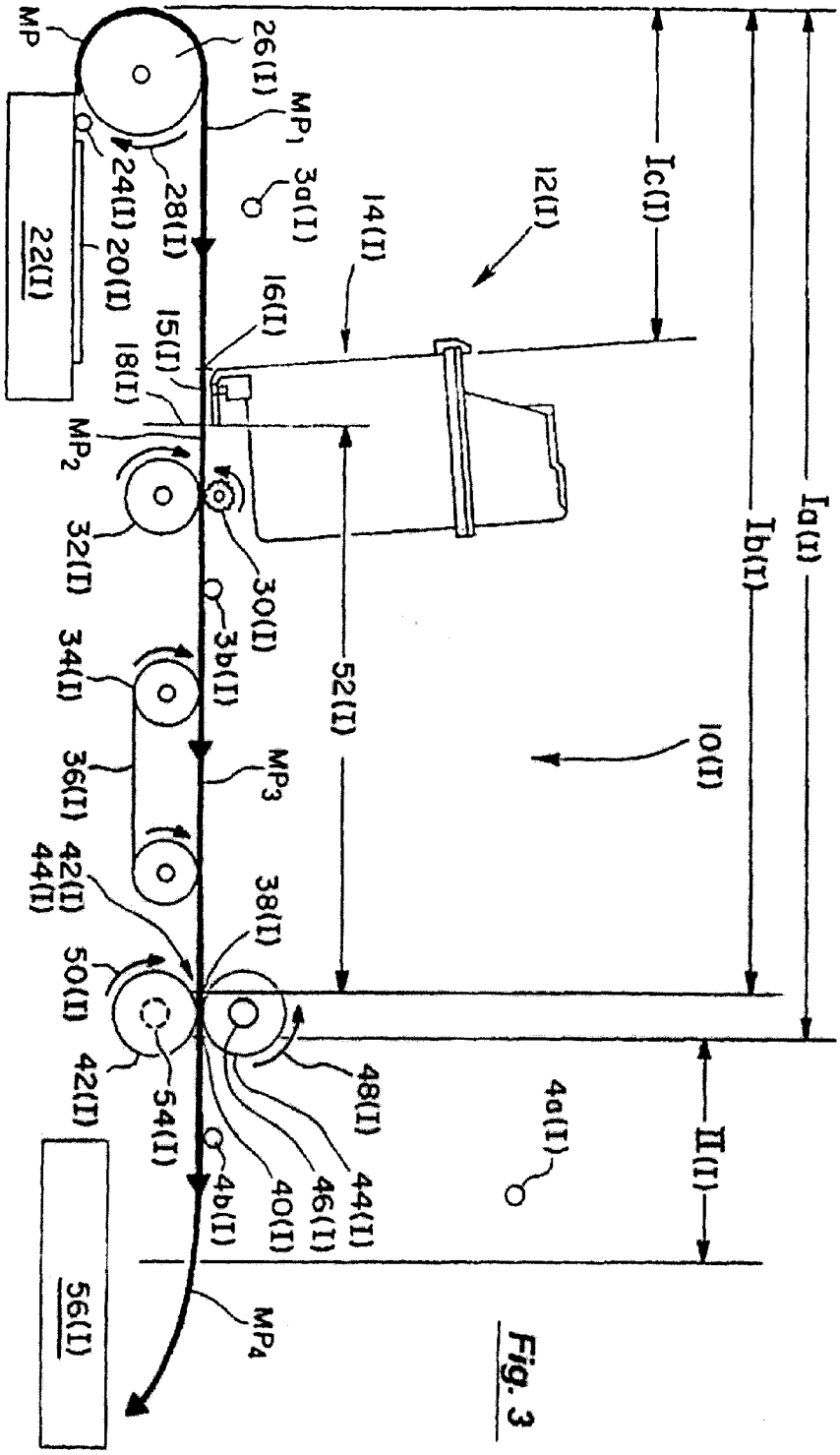

The control system 2 depicted in FIG. 1 also shows second temperature sensors $\mathbf{4}_a$ and $\mathbf{4}_b$ Either or both of them operate in a second zone of the printer (see zone II in the electrophotographic printer 10(E) depicted in FIG. 2 or zone II in the inkjet printer 10(I) depicted in FIG. 3). In such a zone II, sensors $\mathbf{4}_a$ and $\mathbf{4}_b$ can likewise detect an "ambient" temperature in said second zone and/or detect the temperature of a sheet of print media itself as it passes through the second zone. Here again, a print media temperature sensing can be in place of (or in addition to) a sensing of an ambient temperature in said second zone II. Thus, as in the case of the first zone, the second zone is shown (again, by way of example) provided with two temperature sensors (e.g., sensors $\mathbf{4}_a$ and $\mathbf{4}_b$ in FIG. 2 and sensors $\mathbf{4}_{a(1)}$ and $\mathbf{4}_{b(1)}$ in FIG. 3).

Moreover, more than one ambient temperature and/or more than one print media temperature can be taken in the first zone and/or in the second zone. For example, applicant's temperature sensing system can be used to detect an ambient temperature in a given zone, while a second sensor in that zone detects a media temperature in that zone. In such cases involving multiple temperature sensings in a given zone, the multiple temperatures can be processed in various ways, e.g., selection of a highest, lowest, average, etc. temperature. Such a zone temperature can then be used as a basis of comparison with a temperature taken in at least one other zone in the printer. By way of example only, the highest temperature of a first zone (e.g., $I_a$, $I_b$ or $I_c$) can be compared to the highest temperature of a second zone. It also should be noted that the compared temperatures need not necessarily be counterpart temperatures (e.g., comparing a high temperature of a first zone with a high temperature of a second zone). Again, by way of further example, a low or average temperature of the first zone may be compared to a high temperature of the second zone. Likewise, a given temperature from the second zone can be compared to the highest, lowest, average, etc. temperature of the first zone, and so on.

FIG. 1 also shows the control system 2 provided with a microprocessor 5. This microprocessor may be a component of the printer itself or it may be a part of a separate and distinct computer unit (not otherwise shown). In either case, it will carry out several functions needed for the practice of this invention. For example, it will compare temperature-generated signals from a first zone sensor 3 with temperature-generated signals from a second zone sensor 4. Depending on a predetermined differential between these two temperatures, an operating mode selector 6 of the control system 2 is activated (or not activated) by the microprocessor 5. Thus, this temperature comparison and response involves the microprocessor or computer acting in conjunction with a body of data programmed into said microprocessor or computer in ways well known to those skilled in computer programming arts. This body of data will primarily involve temperature related data.

For example, the microprocessor 5 may be programmed such that a temperature differential between sensor 3 and sensor 4 must be of some minimum value before the fuser's temperature mode will be changed. Obviously, tolerances can be programmed into such temperature comparing operations. Thus, if the programmed temperature difference between the first zone and the second zone were, for example, programmed to be 13° C., the fuser unit's temperature mode could be changed at a 13° C.±X° C. difference wherein X is some predetermined tolerance such as 1° C. In certain other embodiments of this invention, this temperature data also may cause the microprocessor 5 or computer to activate other control units that are capable of changing the fuser's operating pressure and/or operating speed.

In any case, a given temperature difference (e.g., 13° C.) can cause an operating mode selector 7 to select any one of the fuser's temperature modes (and pressure modes and/or operating speed modes). By way of example only, item 7 of FIG. 1 depicts a Fuser Mode selector having three temperature modes, e.g., "High, Med and Low". Again, these three modes are given in FIG. 1 for purposes of illustration only. There can be a much larger number of such modes. Each of these modes can be invoked by attainment of a certain temperature differential between sensor 3 and sensor 4. Generally speaking, a large temperature differential between a first zone and a second zone would cause selection of a temperature mode that is more distant (greatly higher or greatly lower) from the temperature mode providing the present temperature differential. For example, a 15° C. delta that implies a need for a higher fuser operating temperature could cause the fuser to operate at about 93° C. (e.g., in the fuser's "High" temperature mode) while a 13° C. delta could cause the fuser to operate at about 91° C. (in the fuser's "Medium" temperature mode). Similarly, a still lower temperature differential could cause selection of the "Low" temperature mode wherein the fuser unit would operate at about 85° C. Again, these examples are merely illustrative of the principle of this invention, i.e., change of a printer's fuser operating temperature based upon detection of a temperature differential between a first sensor and a second sensor.

FIG. 1 also shows a fuser temperature control 8. It carries out a change of temperature order from the microprocessor 5 or computer. It does this by ordering a change in the power delivered to the fuser 9. Such a control 8 could be a switch, a rheostat or other electromechanical control device. As was previously noted, the change will usually be in the nature of a change in the power delivered to a heater element or halogen tube in the core of a heater roller component of the fuser unit. Again, such changes are preferably made on the selection of a temperature mode (e.g., High, Medium, Low) rather than selection of a specific temperature.

FIG. 2 shows a cross sectional view of a generalized, electrophotographic printer 10(E) constructed according to the teachings of this patent disclosure. This electrophotographic printer 10(E) contains a photoconductor drum 12 upon which a latent electrostatic image is placed, and thereafter removed, by methods well known to the electrophotographic printing arts. For example, a charge roller 14 can be used to charge the surface of the photoconductor drum 12 to a predetermined voltage. A laser scanner 15 emits a laser beam 16 which is pulsed on and off as it is swept across the surface of the photoconductor drum 12 and thereby discharging select portions of said surface according to a computer program. The selectively discharged portions of the surface of the drum 12 constitute a latent electrostatic image. The photoconductor drum 12 rotates (e.g., in the clockwise direction suggested by arrow 18) with respect to a developer roller 20.

The developer roller 20 is used to develop the latent electrostatic image in those places where the surface of the photoconductor drum 12 has been selectively discharged by the laser beam 16. Toner particles 22 having magnetic properties, stored in a toner hopper 24 of an electrophotographic print cartridge 26, are moved from within the toner hopper 24 to the developer roller 20. For example, a magnet (not shown) located within the developer roller 20 can be used to magnetically attract toner particles 22 to the surface of the developer roller 20. As the developer roller 20 rotates (e.g., in the counterclockwise direction 25 shown in FIG. 1), the toner particles 22 on the surface of the developer roller 20 are drawn across a gap between the surface of the photoconductor 12 and the surface of the developer roller 20 and thereby develop the latent electrostatic image in those areas of the drum that were discharged by the laser beam 16. This developed electrostatic image is then ready to be transferred to a print medium such as a sheet of paper.

To this end, the printer 10(E) is shown provided with a stack of print media such as a stack of sheets of paper. Individual sheets 28 of the print media are unloaded from a media holding tray 30 by a pickup roller 32. Such a sheet of paper 28 then follows a media path 29 defined within the electrophotographic printer 10(E) by an array of media handling and guiding devices such as rollers, belts, side plate guides and the like. Thus, a sheet of paper 28 is taken from tray 30 and made to traverse the electrophotographic printer 10(E) via media path 29. It is ultimately delivered to an output tray 33. Such a media path 29 may include certain additional features. For example, after being introduced into the printer 10(E), the print media 28 may move through drive rollers 34A and 34B in a manner such that arrival of the leading edge of the print media 28 at a predetermined place below the photoconductor drum 12 is synchronized with rotation of that drum. Thus, a region on the surface of the photoconductor drum 12 carrying a latent electrostatic image can be associated with a specific region on the print media 28. As the photoconductor drum 12 continues to rotate (e.g., in a clockwise direction 18), those portions of the photoconductor drum 12 having toner particles 22 adhering to the discharged areas of the drum's surface are transferred to select regions of the print media 28.

In order to accomplish this toner transfer, the print media 28 passes over a transfer roller 36 and under the photoconductor drum 12. That is to say that the print media passes between the transfer roller 36 and the photoconductor drum 12. Thus, the vertical space between the bottom of the drum 12 and the top of the transfer roller 36 may be regarded as a vertical, toner transfer zone. In it, the transfer roller 36 electromagnetically attracts toner particles 22 away from the surface of the photoconductor drum 12 and onto the top surface of the print media 28. Transfer of toner particles 22 from the surface of photoconductor drum 12 to the surface of the print media 28 does not, however, occur with one hundred percent efficiency. Therefore, some toner particles will remain on the surface of photoconductor drum 12. As photoconductor drum 12 continues to rotate, those untransferred toner particles that continue to adhere to the surface of the drum 12 are removed by a cleaning blade 38 and deposited in a toner waste hopper 40. Having had the untransferred toner particles wiped from its surface, the photoconductor drum 12 is again ready to be charged by charge roller 14 to complete the photoconductor drum's operating cycle.

Meanwhile, as the print media 28 moves further along the media path 29 (i.e., past photoconductor drum 12 and transfer roller 36), a conveyer belt 42 receives and delivers the print-carrying media 28 to an inlet guide or ramp 44 that leads to a fuser unit, e.g., a fuser roller 46/pressure roller 48 system. The fuser 46 component of this system is shown provided with a heat source 49 such as a halogen lamp or heater element. Again, such overall systems are often referred to as "fuser units", "toner fusers" or simply "fusers". Regardless of nomenclature, the print media 28 passes between fuser roller 46 and pressure roller 48 under conditions that apply both heat and pressure to the toner and the print media 28 (e.g., paper) upon which the toner is placed. Preferably, the pressure roller 48 provides a powered, pressured rolling interface relationship between the two rotating roller surfaces. It also provides the motive force needed to pull the print media 28 through the fuser roller 46/pressure roller 48 interface.

This fusing step is essential to virtually all electrostatographic printing processes. In it, the toner that was transferred, in imagewise fashion, from the photoconductor drum 12 onto the print medium 28 is more completely fixed or fused to the print medium by a combination of heat and pressure, and thereby forming a more permanent image on said print medium. Again, only the most basic architecture of such a fuser device 46/48 is shown in FIG. 2. For the sake of simplicity, it is depicted as being comprised of a heater roller 46 and a pressure roller 48. A heat source 49, such as an induction heater element or a halogen lamp, is preferably mounted in a hollow shaft of such a heater roller 46. Preferably, the pressure roller 48 is powered and rolls against (and thereby drives) the heater roller 46. Regardless of which roller is serving as a powered driver roller, the image-bearing sheet of print media passes through an interface between the two rollers. Thus, a combination of heat from the heater roller 46 and pressure from the pressure roller 48 serve to fix the toner to form a permanent image on the media 28. Thereafter, output rollers 50 and 52 nip and pull the print media 28 further along the transport path 29 and eventually help deposit said sheet in an output tray 33. Preferably, the output tray 33 lies outside the housing (e.g., beyond the printer's left, or media output side 56) for easy manual access to the finished print product.

FIG. 2 also is intended to show that the extent of the first zone can vary considerably. It can, for example, extend from a media input side 54 of the printer 10(E) to a point that (preferably) is just prior to the heater/pressure unit 46/48. Such a first zone is shown extending over the distance $I_a$ depicted in FIG. 2. The first zone also could also extend from the printer's media input side 54 to a point that is (preferably) just prior to the interface of the photoconductor drum 12 and interface roller 36. This embodiment of a first zone is shown extending over a distance labeled $I_b$ in FIG. 2. Yet another first zone $I_c$ is depicted as lying between the media input side 54 of the printer 10(E) and a sheet pickup roller 32. Regardless of the extent or definition of this first zone, it will be provided with at least one temperature sensor (e.g., sensor $\mathbf{3}_a$). As was previously discussed, such a sensor $\mathbf{3}_a$ can sense an ambient temperature in the first zone. It can also sense the temperature of a sheet of print media passing through that first zone. In other embodiments of this invention, the first zone will have two or more such temperature sensors. These two or more sensors may sense an ambient temperature, a media temperature or a combination thereof. By way of example only, FIG. 2 shows the first zones $I_a$ and $I_b$ provided with two such temperature sensors $\mathbf{3}_a$ and $\mathbf{3}_b$. Sensor $\mathbf{3}_a$, for example, can be regarded as sensing an ambient temperature while sensor $\mathbf{3}_b$ can be regarded as sensing a print media temperature. This media temperature sensing circumstance is further depicted in FIG. 2 by a lead line $\mathbf{3}_c$ which is shown extending from sensor $\mathbf{3}_b$ to a sheet of print media 28.

The second zone (depicted by distance II in FIG. 2) generally extends from the heater/pressure unit 46/48 to the media output side 56 of the electrophotographic printer 10(E). Here again, this second zone will have at least one temperature sensor e.g., sensor $\mathbf{4}_a$. In other embodiments of this invention, this second zone II will have two or more such sensors that sense an ambient temperature, a media sensor or a combination thereof. For example, FIG. 2 shows two sensors $\mathbf{4}_a$ and $\mathbf{4}_b$ located in the second zone II.

FIG. 3 shows a cross sectional view of a generalized inkjet printer 10(I). It also depicts certain particularly relevant zones of an inkjet printer 10(I) positioned according to the teachings of this patent disclosure. Such an inkjet printer 10(I) has a printhead 12(I) which supports one or more inkjet cartridges 14(I). By way of a well known example, the printhead 12(I) may support four separate ink cartridges for black, yellow, magenta and cyan ink. FIG. 3 also depicts a print zone 15(I) wherein ink is sprayed from one or more nozzles on to a sheet of print media such as a sheet of paper. This print zone 15(I) can be regarded as generally extending from a plain 16(I) on the media path just before the ink nozzle(s) to a plain 18(I) on the media path just after the ink nozzle(s). Thus, for the purposes of this patent disclosure, the expression "beyond the print zone" implies beyond a point in the media path that is intersected by the vertical plane 18(I) that lies just beyond the rear end of the inkjet nozzles.

FIG. 3 also depicts a media sheet 20(I), such as a sheet of paper, about to be removed from a tray 22(I) by the action of a pick roller 24(I). Such pick actions and the various devices used to carry then out are well known in the cut sheet handling arts. In any case, the pick roller 24(I) delivers a media sheet 20(I) to a first part $MP_1$ of a media path that traverses the inkjet printer 10(I). By way of example only, this first part $MP_1$ of the media path is depicted as being initially directed over the outside surface of a powered roller 26(I) that turns in the clockwise direction indicated by arrow 28(I). The powered roller 26(I) can be considered as the initial means by which an individual media sheet 20(I) is delivered to the print zone 15(I). To a large degree, the motion of the print media sheet 20(I) between the powered roller 26(I) and the print zone 15(I) is continuous in nature. That is to say that once the sheet is taken from the tray 22(I) and delivered to the action of the powered roller 26(I), the sheet moves in a generally smooth, continuous manner by virtue of the fact that the powered roller 26(I) rotates at a substantially uniform speed.

This situation is to be contrasted with that same sheet's discontinuous manner of movement through the print zone 15(I) as it is receiving ink from the ink dispensing nozzles. To this end, the print zone 15(I) is shown provided with its own print zone sheet movement or driver device 30(I)/32(I) which, in a highly generalized sense, is shown comprised of a starwheel 30(I) and a complementary exit roller 32(I). Driver devices of this kind are commonly used to provide stop-and-go movement to a sheet of paper as it passes through an inkjet printing zone. The print zone 15(I) also may be considered as a second part $MP_2$ of the overall media path. Again, this distinction between the first part $MP_1$ of the media path and this second part $MP_2$ of the media path is made because media movement through the print zone 15(I) is of a "stop and go" or "discontinuous" nature. This all goes to say that this discontinuous motion through the print zone is separate and distinct from a smooth continuous motion in the first part $MP_1$ of the media path, i.e., over the powered roller 26(I).

As was previously noted, motion along that portion of the media path going through the print zone 15(I) is irregular or discontinuous in nature owing to the fact that the ink dispensing nozzles must be repeatedly moved laterally across the width of the print medium (e.g., across the width of a sheet of paper). Again, at each of a designated number of increments of this lateral or widthwise movement across the medium, each of the nozzles is caused to either eject ink or to refrain from ejecting ink according to the programmed output of a controlling microprocessor. Each completed lateral movement across the medium will therefore print a swath approximately as wide as the number of nozzles arranged in a column on the ink cartridge multiplied by the distance between nozzle centers. Thus, after each such completed widthwise movement or swath, the medium is moved forward along the media path the width of the swath, whereupon the ink cartridge either returns to its starting position and begins its next swath or prints another line of information on its way back to its original position (i.e., bi-directional printing). Again, this discontinuous or stop and go motion through the print zone can be delivered by mechanical actions well known to those skilled in the inkjet printer manufacturing arts, e.g., by the starwheel 30(I)/complimentary exit roller 32(I) system shown in FIG. 3.

After leaving the print zone 15(I), a media sheet 20(I) continues along a third path $MP_3$ of the overall media path 29 under the action of another media path drive device 34(I)/36(I) until it reaches another media path portion $MP_4$. This $MP_4$ part of the media path is generally located between point 38(I) and tray 56(I). In a preferred embodiment of this invention, an inkjet printer is further provided with a heater device such as the heater 42(I)/roller 44(I) system shown in FIG. 3 to further fix the ink to the print media. It also should be appreciated that, unlike electrophotographic printers, inkjet printers are not commonly provided with heater or heater/pressure devices. Such fuser-equipped, inkjet printers are presently being designed.

Again, the heater system also can be a heated plate-like surface under which, or over which, a recently printed sheet passes. Preferably, the media path drive devices, e.g., the sheet drive devices 34(I)/36(I) shown in FIG. 3 that take the sheet from the print zone 15(I) and delivers it to the tray 56(I) and/or to the heater device 42(I)/44(I) is a belt type sheet transport device (e.g., powered roller 34(I) and endless belt 36(I)) that does not "grip" the sheet of media 20(I) in order to advance it along the media path $MP_3$. Be that as it may, this media path device 34(I)/36(I) preferably delivers the sheet 20(I) to a zone generally defined by the interface of a heater/roller device 42(I)/44(I). That is to say that the leading edge 38(I) of this zone can be thought of as the place where the sheet 20(I) is first nipped and then placed in moving contact with the rollers of the heater device 42(I)/44(I). The end point 40(I) of this zone can be thought of as the point where the rear side of the media sheet 20(I) is released from contact with the heater/roller device 42(I)/44(I). In a preferred embodiment of this invention the forward movement of the sheet through the heater/roller device 42(I)/44(I) will also provide enough momentum to the sheet to deposit it in a sheet collection tray 56(I).

The heater/roller device 42(I)/44(I) is preferably comprised of a single roller 42(I) and a single heater roller 44(I). In some of the more preferred embodiments of this invention, the roller 42(I) is powered and the heater roller 44(I) is passive. That is to say that free turning heater roller 44(I) is turned or driven by the powered roller with which it may be in pressured, rolling contact. The heater roller 44(I) is shown turning in a counterclockwise direction 48(I) while the roller 42(I) turns in a clockwise direction 50(I). Consequently, a sheet of media 20(I) will be nipped and then pulled through the zone 38(I)–40(I) by the powered roller action delivered by the heater/roller device 42(I)/44(I). The heater roller 44(I) is shown provided with a heat source 46(I) such as a halogen tube, induction heater element, etc.

The temperature conditions existing in the heater/roller device of the electrophotographic printer embodiments or the inkjet embodiments of this patent disclosure can vary considerably. Moreover, they can vary with respect to the residence time of a sheet of print media (e.g., paper) in such a heater/roller device. Generally speaking, the temperature of the roller surface of the heater roller 44(I) will range between about 300–375° F. Temperatures between about 330° F. and 375° F. are somewhat preferred in those cases where water based inks are employed in the inkjet printing process. The pressure conditions experienced by a sheet of media, and especially a sheet of paper, will generally range between 0 and about 150 psi. Pressures between about 65 and about 130 psi are somewhat preferred, especially when the heater roller temperature is between about 330° F. and about 375° F.

The residence time of a sheet of media in a heater/roller device is largely determined by the angular velocity of a powered drive roller (e.g., roller 42(I)). Typical residence times for an 8½×11 inch sheet of paper will be from about 2 to about 8 seconds per sheet. Residence times of about 3 to about 6 seconds are more preferred. These preferred residence times generally correspond to 8½×11 inch paper processing rates of about 16 to about 32 sheets per minute. Generally speaking, the shorter residence times will be used as the operating temperature is raised. For example, the lower end of the residence time range (e.g., 2–3 seconds) will generally be preferred as the temperature is raised toward the upper end of its preferred range (e.g., 330–375° F.0.

Preferably, a media sheet 20 is powered through the heater/roller device 42(I)/44(I) in a smooth continuous fashion. This smooth, continuous action extends to the media path segment generally designated as $MP_4$ in FIG. 3. This smooth, continuous action is to be again contrasted with the irregular, discontinuous action experienced by the media sheet 20(I) in the print zone 15(I). That is to say that the continuous motion through the heater/roller 42(I)/44(I) is qualitatively different from the stop and go (i.e., discontinuous), motion through the print zone provided by the print zone driver device 30(I)/32(I). Thus, it is highly preferred that the sheet 20(I) be completely released or disengaged from the discontinuous action provided by the print zone driver device 30(I)/32(I) before it is delivered to the continuous action provided by the heater/roller device 42(I)/44(I).

Again, a transition between these two kinds of sheet movement is preferably accomplished through use of a roller/belt device 34(I)/36(I) that does not grip the sheet of media 20(I) as it advances it from the print zone end point 18(I) to the heater/roller device 42(I)/44(I). Be the sheet transport transition apparatus as it may, the distance 52(I) between the end 18(I) of the print zone 15(I) and the beginning 38(I) of the roller 42(I)/heater roller 44(I) nip or interface is preferably greater than the length of the print media sheet 20 being so advanced. For example, in the case of a standard 8½×11 inch sheet of paper, this distance 52 preferably will be greater than 11 inches.

The inkjet printer 10(I) depicted in FIG. 3 also is shown provided with several first zones e.g., zone $I_{a(I)}$, $I_{b(T)}$ and/or $I_{c(I)}$. For example, such a first zone $I_{a(I)}$ might extend from the powered roller 26(I) to a point beyond the plane 18(I) defining the end of the print zone 15(I) and up to the second zone $II_{(I)}$. If the inkjet printer is provided with a heater device (such as the heater device 42(I)/44(I) shown in FIG. 3, or a flat, plate-like heater device), a first zone $I_{b(I)}$ might extend up to such a heater device. Another preferred first zone $I_{c(I)}$ is shown positioned between the powered roller 26 and a plane 16(I) intersecting the media path just before the ink nozzle(s). First zones $I_{a(I)}$ and $I_{b(I)}$ are shown provided with sensors $\mathbf{3}_{a(I)}$ and $\mathbf{3}_{b(I)}$. First zone $I_{c(I)}$ shown provided one sensor $\mathbf{3}_{a(I)}$. The second zone II is, by way of example, also shown provided with two sensors $\mathbf{4}_{a(I)}$ and $\mathbf{4}_{b(I)}$.

It also should be appreciated that the principles of this invention can be applied to inkjet printers where temperatures are taken from more than one "first zone", then processed and then acted upon. By way of example only, a Zone $I_c$ temperature could be taken first. This first temperature sensing could then be followed by a taking of a Zone $I_b$ temperature and then by a taking of a Zone $I_a$ temperature. A change in, or a predetermined differential between, two, three, etc. Zone I temperatures (e.g., a temperature differential between Zone $I_c$ and Zone $I_a$) could be compared to a Zone II temperature in order to obtain a temperature differential (delta) which will cause the microprocessor to change the fuser unit to a different temperature. Analogous, multiple readings taken in Zone II could likewise be processed (e.g., selection of highest, lowest, average, etc.) and acted upon with respect to a Zone I temperature.

Although specific embodiments of this invention have been disclosed herein in detail, it is to be understood that this was for purposes of illustration only. Consequently, this patent disclosure is not to be construed as limiting the scope of the invention, since the hereindescribed printers (electrophotographic printers, and by implication inkjet printers) may be changed in several details by those skilled in the art in order to adapt these printers to particular applications without departing from the scope of the following claims and equivalents of the claimed elements.

I claim:

1. A printer comprising a printing device and a fuser capable of operating at different temperatures according to signals from a microprocessor and wherein said printer further comprises:

(1) a first temperature sensor positioned prior to the fuser;

(2) a second temperature sensor; and (3) a microprocessor for determining a difference between a temperature sensed by the first temperature sensor and a temperature sensed by the second temperature sensor and then sending an electrical signal to the fuser in order to change said fuser's operating temperature based upon said difference.

2. A printer comprising a printing device and a fuser capable of operating at different temperatures according to signals from a microprocessor and wherein said printer further comprises:

(1) a first zone having a first temperature sensor positioned prior to the fuser;

(2) a second zone having a second temperature sensor; and (3) a microprocessor for determining a difference between a temperature sensed in the first zone and a temperature sensed in the second zone and then sending an electrical signal to the fuser in order to change said fuser's operating temperature based upon said difference.

3. The printer of claim 2 wherein the printing device is an electrophotographic printer.

4. The printer of claim 2 wherein the printing device is an inkjet printer.

5. The printer of claim 2 wherein the first temperature sensor senses an ambient temperature in the first zone.

6. The printer of claim 2 wherein the first temperature sensor senses the temperature of a sheet of print media in the first zone.

7. The printer of claim 2 wherein the second temperature sensor senses an ambient temperature in the second zone.

8. The printer of claim 2 wherein the second temperature sensor senses the temperature of a sheet of print media in the second zone.

9. The printer of claim 2 wherein the first zone is located between a sheet input side of the printer and a point on a media path through the printer that is just prior to the fuser.

10. The printer of claim 2 wherein the first zone is located between a sheet input side of the printer and a point on a media path through the printer that is prior to a printing composition transfer zone.

11. The printer of claim 2 wherein the microprocessor sends electrical signals to the fuser in order to change said fuser's operating temperature and its operating pressure.

12. The printer of claim 2 wherein the microprocessor sends electrical signals to the fuser in order to change said fuser's operating temperature and its operating speed.

13. The printer of claim 2 wherein the microprocessor sends electrical signals to the fuser in order to change said fuser's operating temperature, pressure and speed.

14. The printer of claim 2 wherein the fuser unit has two opposing rollers and wherein at least one of the two opposing rollers contains a heating device employing an inductive heater element.

15. The printer of claim 2 wherein the fuser has two opposing rollers and wherein at least one of the two opposing rollers contains a heating device employing a halogen tube.

16. The printer of claim 2 wherein the fuser unit has two opposing rollers and wherein each of the two opposing rollers contains a heating device.

17. The printer of claim 2 wherein the first zone has more than one temperature sensor.

18. The printer of claim 2 wherein the second zone has more than one temperature sensor.

19. An electrophotographic printer comprising a laser printing device, photoconductor drum, toner dispenser, toner transfer device and a toner fuser unit capable of operating at different temperatures according to signals from a microprocessor and wherein said electrophotographic printer further comprises:

(1) a first zone having a first temperature sensor positioned prior to the fuser;

(2) a second zone having a second temperature sensor; and (3) a microprocessor for determining a temperature difference between a temperature sensed in the first zone and a temperature sensed in the second zone and then sending an electrical signal to the toner fuser in order to change said fuser's operating temperature.

20. An inkjet printer comprising an inkjet printing device and an ink fuser capable of operating at different temperatures according to signals from a microprocessor unit and wherein said inkjet printer further comprises:

(1) a first zone having a first temperature sensor positioned prior to the fuser;

(2) a second zone having a second temperature sensor; and (3) a microprocessor for determining a temperature difference between a temperature sensed in the first zone and a temperature sensed in the second zone and then sending an electrical signal to the ink fuser in order to change said fuser's operating temperature.

* * * * *

UNITED STATES PATENT AND TRADEMARK OFFICE

CERTIFICATE OF CORRECTION

PATENT NO. : 6,390,696 B1
DATED : May 21, 2002
INVENTOR(S) : Tom Concannon

It is certified that error appears in the above-identified patent and that said Letters Patent is hereby corrected as shown below:

Drawings,
Please replace Fig. 3 with the attached Fig. 3.

Signed and Sealed this

Seventeenth Day of December, 2002

JAMES E. ROGAN
*Director of the United States Patent and Trademark Office*